US009581125B2

(12) United States Patent
Yaguchi et al.

(10) Patent No.: US 9,581,125 B2
(45) Date of Patent: Feb. 28, 2017

(54) INTERNAL-COMBUSTION ENGINE IGNITION DEVICE AND IGNITION METHOD

(75) Inventors: Tatsuya Yaguchi, Yokohama (JP); Taisuke Shiraishi, Kawasaki (JP)

(73) Assignee: NISSAN MOTOR CO., LTD., Yokohama-shi, Kanagawa (JP)

( * ) Notice: Subject to any disclaimer, the term of this patent is extended or adjusted under 35 U.S.C. 154(b) by 406 days.

(21) Appl. No.: 14/350,384

(22) PCT Filed: Aug. 14, 2012

(86) PCT No.: PCT/JP2012/070686

§ 371 (c)(1),
(2), (4) Date: Apr. 8, 2014

(87) PCT Pub. No.: WO2013/065382

PCT Pub. Date: May 10, 2013

(65) Prior Publication Data

US 2014/0238347 A1 Aug. 28, 2014

(30) Foreign Application Priority Data

Oct. 31, 2011 (JP) ..... 2011-238637
Feb. 3, 2012 (JP) ..... 2012-021421

(51) Int. Cl.
*F02P 15/00* (2006.01)
*F02P 5/04* (2006.01)
(Continued)

(52) U.S. Cl.
CPC ..... *F02P 5/04* (2013.01); *F02P 9/002* (2013.01); *F02P 15/08* (2013.01); *F02P 15/10* (2013.01); *F02P 23/04* (2013.01)

(58) Field of Classification Search
CPC ..... F02P 9/002; F02P 15/08
See application file for complete search history.

(56) References Cited

U.S. PATENT DOCUMENTS

2001/0002591 A1* 6/2001 Majima ..... F02D 37/02 123/406.24
2007/0181110 A1* 8/2007 Toriyama ..... F02P 3/0552 123/637

(Continued)

FOREIGN PATENT DOCUMENTS

EP 0 893 600 A1 1/1999
JP S61-27588 B2 6/1986

(Continued)

OTHER PUBLICATIONS

Swett et al., "Spark Ignition of Flowing Gases Using Long-Duration Discharges", Symposium (International) on Combustion, vol. 6, No. 1, Jan. 1, 1957, pp. 523-532, XP055230306, ISSN: 0082-0784.

(Continued)

*Primary Examiner* — Thomas Moulis
(74) *Attorney, Agent, or Firm* — Drinker Biddle & Reath LLP

(57) ABSTRACT

In an ignition device of an internal combustion engine which carries out ignition of an air-fuel mixture by repeatedly applying a voltage across electrodes of an ignition plug thereby producing a plurality of discharges, an improvement is proposed in which in the presence of gas flow of which direction is perpendicular to a direction that connects the electrodes with a shortest distance, a time interval between n-th time discharge and (n−1)-th time discharge is so set that a discharge channel caused or proposed by the n-th time discharge is more extended in the gas flow direction than a discharge channel caused by the (n−1)-th time discharge.

8 Claims, 8 Drawing Sheets

(51) Int. Cl.

| | |
|---|---|
| ***F02P 9/00*** | (2006.01) |
| ***F02P 15/08*** | (2006.01) |
| *F02P 15/10* | (2006.01) |
| *F02P 23/04* | (2006.01) |

(56) References Cited

U.S. PATENT DOCUMENTS

| | | | | |
|---|---|---|---|---|
| 2011/0144881 | A1* | 6/2011 | Glugla | F02P 15/08 701/102 |
| 2011/0168145 | A1 | 7/2011 | Mori | |
| 2014/0261319 | A1* | 9/2014 | Kimura | F02P 15/08 123/406.45 |
| 2015/0316019 | A1* | 11/2015 | Kimura | F02P 9/002 123/406.19 |
| 2016/0003209 | A1* | 1/2016 | Bertsch | F02D 41/3023 123/406.47 |
| 2016/0010616 | A1* | 1/2016 | Kimura | F02D 41/18 123/146.5 R |

FOREIGN PATENT DOCUMENTS

| | | | |
|---|---|---|---|
| JP | H03-281982 | A | 12/1991 |
| JP | 2008-303841 | A | 12/2008 |
| JP | 2009-047149 | A | 3/2009 |
| JP | 2009-287521 | A | 12/2009 |

OTHER PUBLICATIONS

Prysiazhnevych et al., "Influence of the Discharge Current and Gas Flow Rate on the Non-Equilibrium Level of Plasma of the Transverse Arc in Air at Atmospheric Pressure", Jun. 14, 2012, XP055244283, URL:http://escampig2012.ist.utl.pt/Proceedings/files/Topic.

"Switches—why does electric arc in a switch prefer a curved path over a straight path? Electrical Engineering Stack Exchange", Feb. 3, 2012, XP055244272, URL:http://electronics.stackexchange.com/questions/26084/why-does-electric-arc-in-a-switch-prefer-acurved-path-over-a-straight-path.

* cited by examiner

INTERNAL-COMBUSTION ENGINE IGNITION DEVICE AND IGNITION METHOD

TECHNICAL FIELD

The present invention relates to an ignition device of an internal combustion engine and an ignition method of the same, which carry out ignition of an air-fuel mixture by repeatedly applying a voltage across electrodes of an ignition plug thereby producing a plurality of discharges.

BACKGROUND ART

In, for example, Patent Documents 1 and 2, there is disclosed a technology in which for assuredly igniting a mixture of is fuel and air in a combustion chamber, a voltage is repeatedly applied across electrodes of an ignition plug thereby producing a plurality of discharges.

In the technology of Patent Document 1, for example three side electrodes are arranged around a center electrode of an ignition plug and a voltage is pulsively applied to the electrodes thereby to produce a spark discharge between the center electrode and each of the side electrodes in turn. In this technology, by increasing the voltage application interval by a certain degree, a next discharge is forced to appear between the center electrode and one of the side electrodes without inducing a discharge between the center electrode and another one of the side electrodes that has just participated in producing the last discharge.

In the technology of Patent Document 2, prior to a main discharge that forms an arc discharge, a plurality of pulse discharges, which form streamer discharges or glow discharges, are carried out, so that the active species concentration is increased immediately before the arc discharge or main discharge.

In general, the active species are radicals (including excited condition of ion and bound electron), electrons, atoms, molecule internal oscillations, translation motions, etc. Since, after production by the discharge, these active species are transited to a stable condition with passage of time, the life of the active species is relatively short.

In general, in a combustion chamber of an internal combustion engine, there is a flow of air-fuel mixture or gas flow that is to be ignited. For example, in case of reciprocating internal combustion engines in which pistons move up-and-down, a gas flow is produced in each cylinder due to the up-and-down to movement of the piston. Particularly, in a lean air-fuel mixture that has a high air-fuel ratio or an air-fuel mixture that contains a large amount of exhaust gas recirculated through an EGR system, a combustion speed is lowered and thus the combustion is made unstable. Thus, in order to compensate the combustion instability, attempts for positively producing the gas flow are usually carried out. One of them is to provide in an intake passage a device that produces in each combustion chamber a gas flow such as tumble flow, swirl flow or the like, and the other of them is to make the gas flow more active by adjusting an open timing or open angle of the intake valves.

If such gas flow is present near an ignition plug, active species produced as a result of the discharge and flame cores (or kernels) are forced to flow downstream by the gas flow and thus, usually, ignition becomes much difficult. Patent Documents 1 and 2 take no thought of influence of such gas flow.

For example, in the method of Patent Document 1, due to a considerable influence of the gas flow, the discharge tends to take place at only a particular side electrode, which is an uneven distribution problem.

Furthermore, in the technology of Patent Document 2, in presence of the gas flow, the active species produced as a result of pulse discharge effected prior to the main discharge is forced to flow downstream, and thus, at the time when the main discharge is actually carried out, the active species fail to exist in large quantity around the main discharge, and thus, the effect of promoting a flame propagation due to the active species is lowered.

The present invention aims to provide an ignition device and an ignition method, which are able to more assuredly and effectively make an ignition to an air-fuel mixture in the presence of the gas flow.

PRIOR ART DOCUMENTS

Patent Documents

Patent Document 1: Japanese Patent Publication (tokkousho) 61-27588

Patent Document 2: Japanese Laid-open Patent Application (tokkai) 2009-47149

SUMMARY OF INVENTION

In an ignition device and an ignition method of an internal combustion engine according to the present invention, a voltage is repeatedly applied across electrodes of an ignition plug to produce a plurality of discharges for carrying out ignition to an air-fuel mixture.

In one embodiment of the present invention, under a condition wherein a velocity component of a gas flow is present in a direction perpendicular to a direction along which the shortest distance (or shortest way) between the electrodes is defined, a time interval between n-th time discharge and (n−1)-th time discharge that is just before the n-th time discharge is so set that a discharge channel caused or produced by the n-th time discharge is more extended in the gas flow direction than a discharge channel caused by the (n−1)-th time discharge. The discharge channel indicates the route that emits light upon the discharge.

In another embodiment of the present invention, under a condition wherein a velocity component of a gas flow is present in a direction perpendicular to a direction along which the shortest distance between the electrodes is defined, the n-th time discharge is carried out while a resistance of a discharge route made when the active species produced as a result of the (n−1)-th time discharge are forced to flow downstream by the gas flow is smaller than a resistance of the route that connects the shortest distance. The discharge route in this case is a route to which a discharge is expected or estimated, and this discharge route is substantially the same as the above-mentioned discharge route, so that when a discharge is actually effected along the discharge route, the route becomes a discharge channel.

As is well known, when a potential difference between electrodes reaches a certain level, a gas placed between the to electrodes is subjected to an insulation breakdown thereby inducing an electric discharge. Upon discharging between the electrodes, active species such as radicals and the like are produced due to collision between the air-fuel mixture gas and electrons and thus the resistance is locally lowered. The active species have a limited life and the working of the active species disappears in a relatively short time. Particularly, since, in the presence of gas flow, the active species produced are forced to flow downstream by the gas flow, the resistance between the electrodes, particularly, the resistance of the route that connects the shortest distance between the electrodes is increased again relatively quickly.

When paying attention to the active species that are forced to flow downstream by the gas flow, it is realized that the active species are placed downstream of a position where a previous discharge took place until the life of the active species disappears, and thus, the resistance lowering at such portion takes place. Accordingly, if a voltage is applied between the electrodes again before the working of the active species disappears, it may occur that a discharge takes place at a gas flow position downstream of the position where the previous discharge took place. Typically, the discharge channel at this time is not a straight line that connects the shortest distance between the electrodes, but a curved line that swells out toward the downstream side of the gas flow. The active species produced by such curved discharge channel are forced to flow more downstream by the influence of the gas flow, and thus, a next discharge that uses the active species may take place at a more downstream side. When, like this, the discharge gradually takes place at the downstream side due to the repeated voltage application, the discharge channel is gradually extended or shifted toward the outside.

However, the length of the swelled discharge route is greater than that of a linear discharge route, and thus, if the working of the active species becomes weakened due to for example a time passage, the next discharge takes place along the linear route. That is, if the next discharge is effected while the resistance of the downstream discharge route produced due to the downstream flow of the active species by the gas flow is lower than the resistance of the route that connects the shortest distance between the electrodes, the discharge takes place one after another at the downstream side along the direction of the gas flow, and thus, the discharge channel is gradually extended. Like this, the longer discharge channel is advantageous in generating an initial flame since it can increase a plasma volume.

Thus, according to the present invention, a longer discharge channel that is gradually extended outward due to the repeated voltage application is stably produced in the presence of gas flow in the combustion chamber, and thus more assured ignition is possible.

EMBODIMENTS FOR CARRYING OUT INVENTION

In the following, a preferable embodiment of the present invention will be described with reference to the drawings.

Figure 1:
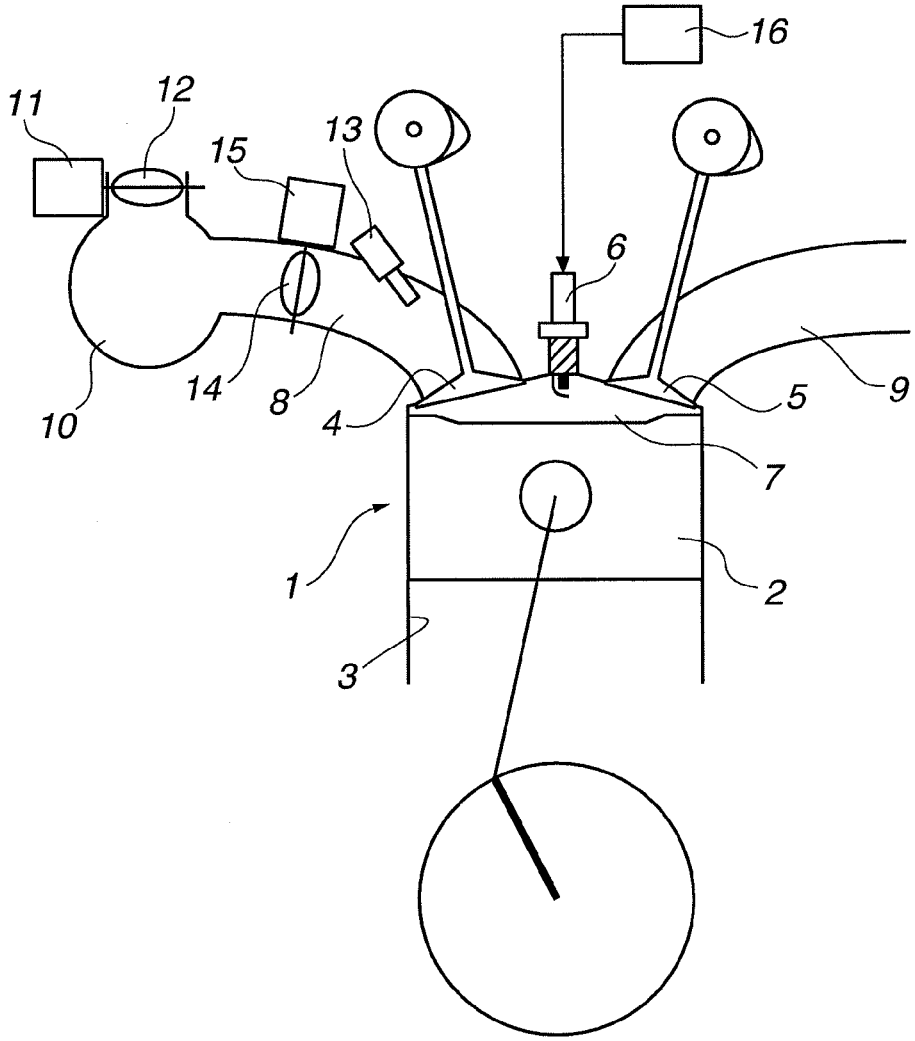
FIG. 1 is an illustration of an internal combustion engine equipped with an ignition device of the present invention.

FIG. 1 shows an example of internal combustion engine 1 that is equipped with an ignition device of the present invention. The internal combustion engine 1 is constructed as a four stroke cycle spark ignition gasoline engine. That is, at a top part of each cylinder in which a piston 2 is received, there are arranged, for example, a pair of intake valves 4 and a pair of exhaust valves 5, and at a center portion of a ceiling surface that is surrounded by the intake valves 4 and exhaust valves 5, there is arranged an ignition plug 6. To a combustion chamber 7, there are connected an intake port 8 through the intake valves 4 and an exhaust port 9 through the exhaust valves 5. The intake port 8 is connected at its upstream portion to an intake air collector 10, and at an inlet portion of the inlet air collector 10, there is arranged a throttle valve 12 that is selectively opened and closed by an actuator 11 constructed by an electric motor.

To each intake port 8, there is connected a fuel injection valve 13 that injects fuel toward the intake valves 4, and in each intake port 8, there is arranged a gas flow control valve 14 that positively produces a gas flow (for example, swirl flow or tumble flow) in the combustion chamber 7. The gas flow control valve 14 is of a type in which an opening degree is controlled by an actuator constructed by an electric motor and the swirl flow or the tumble flow in the combustion chamber 7 is enhanced by decentering the intake air flow in the intake port 8.

Application of the present invention is not limited to the above-mentioned internal combustion engine 1. That is, the present invention is applicable to various spark ignition type internal combustion engines, for example cylinder injection type internal combustion engines or internal combustion engines of a type that is free of a device, such as the gas flow control valve 14 or the like, that varies the gas flow.

In the combustion chamber 7, there is produced a gas flow by the up-down motion of the piston 2 and the air inflow through the intake valves 4. The gas flow has a previously designed strength to promote flame propagation, and even when a device such as the gas flow control valve 14 is provided, the gas flow control valve 14 is so controlled as to basically establish a gas flow that has been previously designed in accordance with a driving condition. Accordingly, the strength of the gas flow is basically known.

Figure 3:
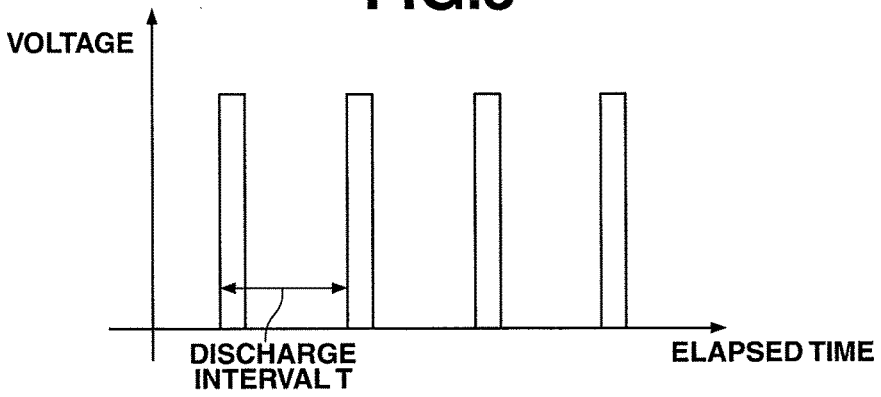
FIG. 3 is a waveform chart that shows one example of a pulsed voltage applied between electrodes.
Figure 4:
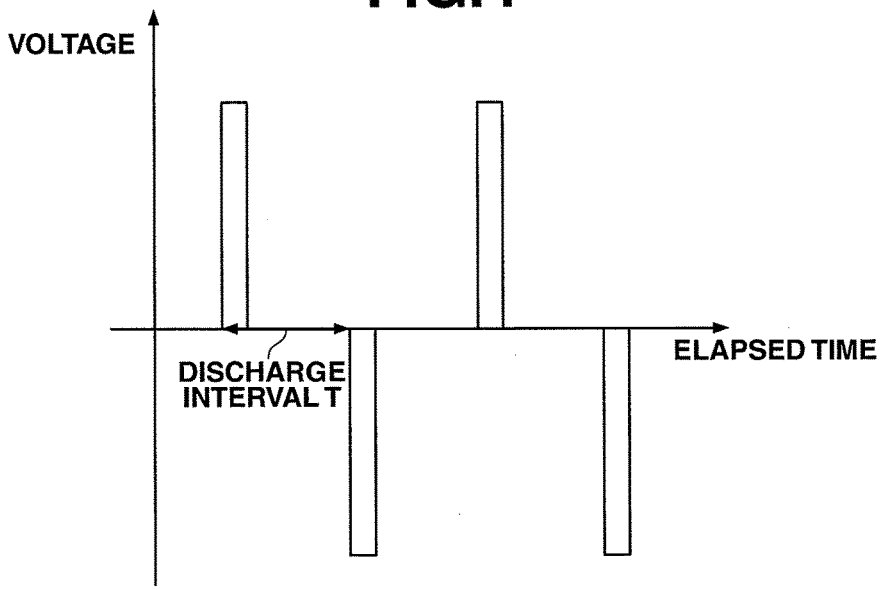
FIG. 4 is a waveform chart that shows another example of the pulsed voltage applied between the electrodes.
Figure 5:
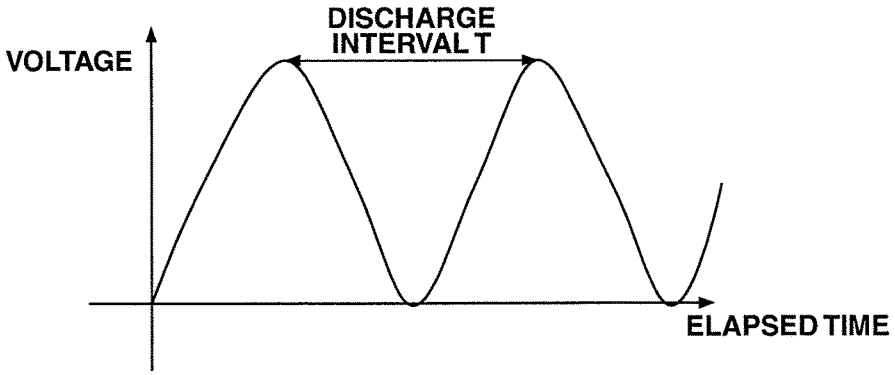
FIG. 5 is a waveform chart that shows still another example of the pulsed voltage applied between the electrodes.
Figure 6:
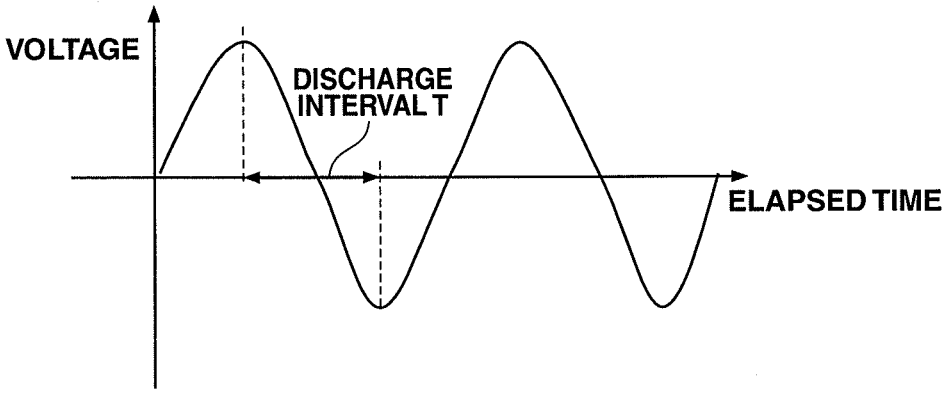
FIG. 6 is a waveform chart that shows a further example of the pulsed voltage applied between the electrodes.

To the ignition plug 6, there is connected a high voltage generating circuit 16 that is able to apply pulsed voltage to the ignition plug at relatively short intervals. One example of is the circuit is a unipolar type high voltage generating circuit 16 that is able to provide pulsed voltage having a rectangular waveform as shown in FIG. 3. In the present invention, the waveform is not limited to the rectangular waveform of FIG. 3. That is, the circuit may be a bipolar type high voltage generating circuit 16 that is able to provide pulsed voltage having a rectangular waveform as shown in FIG. 4. Furthermore, the circuit may be a unipolar type high voltage generating circuit 16 that outputs a triangular waveform as shown in FIG. 5 or a bipolar type high voltage generating circuit 16 that outputs a triangular waveform as shown in FIG. 6. In each waveform, a discharge interval T is defined as is indicated in the waveform chart.

Figure 2:
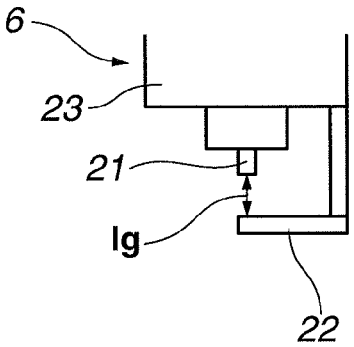
FIG. 2 is an illustration of an essential part of an ignition plug.

As is seen from FIG. 2, the ignition plug 6 used in this embodiment has such an ordinary structure as to comprise a rod-shaped center electrode 21 that extends along a central axis of a plug body 23 of the ignition plug 6 and an L-shaped side electrode 22 that is arranged to face the center electrode 21. When a sufficiently high potential difference is applied from the high voltage generating circuit 16 between the electrodes 21 and 22 of the ignition plug 6, an insulation breakdown is produced thereby inducing generation of a discharge between the electrodes 21 and 22. Particularly, when pulsed high voltage is repeatedly applied, discharge is repeatedly produced for many times. Due to such discharge, there is produced a lightening phenomenon along the discharge route. In the present invention, such route that emits light upon discharge will be called or named "discharge channel". In the above-mentioned structure of the electrodes 21 and 22, a straight line segment that connects outer surfaces of the electrodes 21 and 22 along the center axis of the center electrode 21 constitutes a shortest distance lg between the two electrodes 21 and 22.

Figure 7:
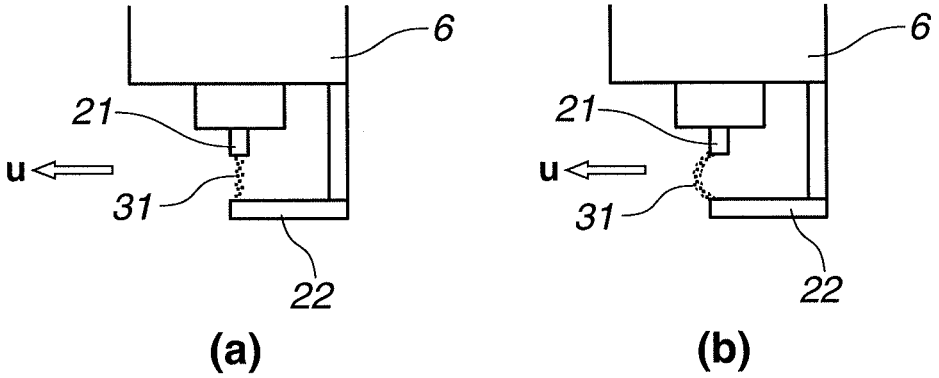
FIG. 7 shows illustrations respectively showing (a) a discharge channel produced at a first time and (b) a discharge channel produced at a second time, in the presence of the gas flow.

Drawings of FIG. 7 show a discharge channel (designated by numeral 31) in the presence of gas flow. In these drawings, designated by u is the gas flow of which direction is is perpendicular to a direction connecting the shortest distance lg of the electrodes 21 and 22. FIG. 7(*a*) shows a discharge channel caused by a first discharge. As is seen from this drawing (a), even when a strong gas flow is provided, the first discharge, that is, the discharge channel is formed along the shortest distance lg of the two electrodes 21 and 22. Although this first discharge causes an insulation breakdown of the air-fuel mixture, the breakdown is very short in time, and thus, the influence of the gas flow to the discharge channel produced is negligibly small.

When like this the discharge takes place, the active species are produced along the discharge channel and thus the resistance in the air-fuel mixture is lowered. However, the active species that are subjected to a lowering in resistance are forced to flow toward a downward side in the presence of the gas flow u. Accordingly, although in a very short time or period, there is a time during which the resistance of the air-fuel mixture placed along the active species present in a downstream side from the shortest distance lg is lower than the resistance of the air-fuel mixture placed along the shortest distance lg of the two electrodes 21 and 22. Accordingly, when, during this time or period, a second time application of high voltage is carried out, there is produced a discharge along a route of which resistance is relatively low as is seen from (b) of FIG. 7, and thus, there is produced a curved discharge channel that is swelled in a downstream direction, not the discharge channel connecting the shortest distance lg. That is, there is produced a discharge channel of which route length is longer than that of the shortest distance lg.

Also the active species produced by the second discharge are forced to move downward by the influence of the gas flow u, and thus, like the above, the resistance of the air-fuel mixture present in a place more downstream than the discharge channel of FIG. 7(*b*) becomes temporarily lower than the resistance of the air-fuel mixture placed along the shortest distance lg of the two electrodes 21 and 22. Accordingly, when, within this time or period, a third time application of high voltage is carried out, there is produced a discharge channel at a position more downstream than the discharge channel of FIG. 7(*b*).

As is mentioned hereinabove, when application of a high voltage is carried out at sufficiently short intervals considering the life of the active species in the presence of the gas flow u, the discharge channel is gradually extended toward a downstream side thereby increasing the length of the discharge channel. The discharged channel thus elongated contributes to growth of flame core (or flame kernel) and shortening of the initial combustion period, and thus, much assured ignition is obtained in the presence of gas flow u. It can be said that the length of the discharge channel indicates a magnitude of energy that is put into the air-fuel mixture upon discharge, and thus, it can be said that the energy put into the air-fuel mixture is increased as the length of the discharge channel increases.

Figure 8:
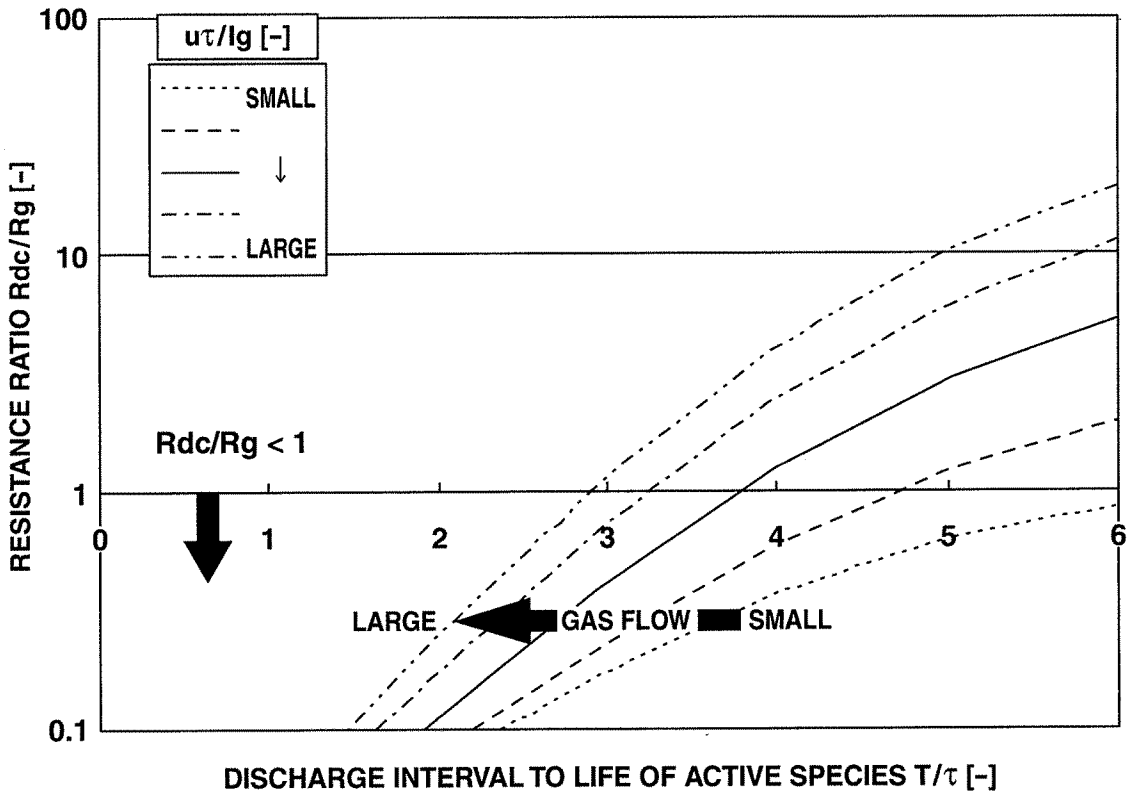
FIG. 8 is a characteristic diagram showing a characteristic of a resistance ratio (Rdc/Rg) against a gas flow and a discharge interval.
Figure 9:
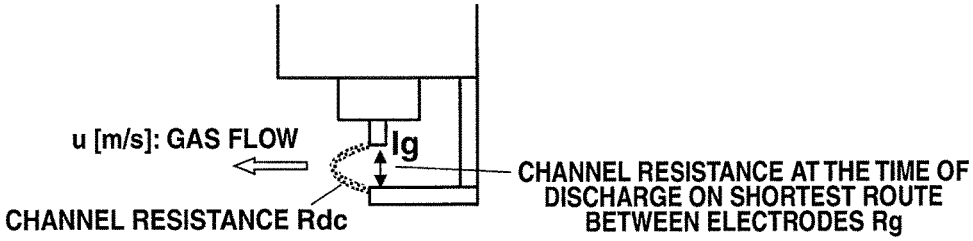
FIG. 9 is an illustration depicting parameters explained in FIG. 8.

FIG. 8 is a characteristic diagram showing in an organized way a discharge interval (viz., interval at which high voltage is applied) T required for extending the discharge channel caused by the second discharge outward beyond the discharge channel caused by the first discharge. In this diagram, as is seen from FIG. 9, a velocity of the gas flow is represented by u[m/s], the shortest distance between the electrodes 21 and 22 is represented by lg[m], the resistance of the air-fuel mixture that is placed along the shortest distance lg is represented by Rg[Ω] and the resistance of air-fuel mixture placed along the discharge route that is extended toward the downstream side by the influence of the active species is represented by Rdc[Ω]. The life of the active species is represented by τ[s].

The resistance of the air-fuel mixture placed along to the discharge route that is extended toward the downstream side lowers in accordance with production of the active species, increases with the passage of time due to the life of the active species and increases as the route length of the discharge route (viz., discharge channel) increases. In FIG. 8, the resistance Rdc is evaluated with the aid of a ratio ((viz., dimensionless resistance ratio (Rdc/Rg)) of the resistance Rdc relative to the resistance Rg of the air-fuel mixture placed along the shortest distance lg. Furthermore, the discharge interval T[s] is evaluated with the aid of a ratio ((viz., dimensionless ratio (T/τ)) of the discharge interval T[s] relative to the life τ[s] of the active species. And, the gas flow u[m/s] is evaluated as dimensionless parameter (uτ/lg) taking the influence of large/small of the shortest distance lg[m] and influence of the life τ[s] of the active species into consideration.

By carrying out the above-mentioned organization, as is seen from FIG. 8, a value of the resistance ratio (Rdc/Rg) relative to the discharge interval (T/τ) is obtained for each dimensionless gas flow (uτ/lg). Now, in order to extend the discharge channel caused by the second discharge outward beyond the shortest distance lg, it is necessary to make the resistance Rdc of the air-fuel mixture placed along the outside discharge route lower than the resistance Rg of the air-fuel mixture placed along the shortest distance lg, that is, it is necessary to make the resistance ratio (Rdc/Rg) smaller than 1 (one). Accordingly, if the discharge interval (T/τ) is set relative to the gas flow (uτ/lg) in such a manner that the resistance ratio (Rdc/Rg) is placed in a range smaller than 1 (one) in FIG. 8, the discharge channel caused by the second discharge is extended outward beyond the shortest distance lg. When, like this, the discharge channel is extended, increase in plasma volume, growth of flame core and shortening of the initial combustion period are established, and assured ignition is obtained in the presence of gas flow.

The resistance Rg, Rdc between the electrodes 21 and 22, which is defined now, is a resistance of the air-fuel mixture established just before discharging. Particularly, the resistance at the time of the first discharge is a resistance established just before the insulation breakdown and usually 100 kΩ or more. At the time of the second discharge and is subsequent discharges, the active species caused by previous discharge or discharges are unevenly distributed in the air-fuel mixture, so that there is produced a spatial distribution of resistance value in the combustion chamber 7. Due to the spatial distribution of the active species concentration, the resistance of the air-fuel mixture at the time of discharge is changed. Since the strength of the gas flow near the ignition plug 6 at the time of the ignition is known, it is possible to estimate or forecast the resistance Rdc of the discharge route that has been moved toward the downstream side by the gas flow by grasping the concentration, the resistance ratio and the life of the active species produced by the discharges.

Regarding the third discharge and subsequent discharges, similar phenomenon takes place. That is, if the discharge interval T is so set that the resistance Rdc of the discharge route that has been moved toward the downstream side at the n-th time discharge is lower than the resistance Rg of the discharge route along the shortest distance lg, the discharge channel is gradually extended toward the downstream side of the gas flow u.

Figure 10:
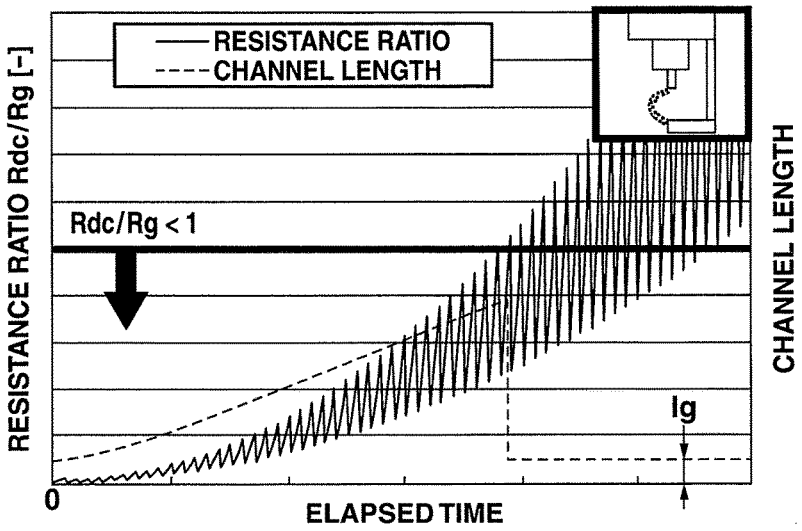
FIG. 10 is a time chart that depicts a resistance ratio (Rdc/Rg) used in an embodiment with a small discharge interval and a temporal change of the length of a discharge channel.

FIG. 10 shows a transition of the resistance ratio (Rdc/Rg) and the length of the discharge channel with respect to an elapsed time in case where the discharge interval T is set in the above-mentioned manner. In this example, at the second discharge and subsequent discharges, the resistance ratio (Rdc/Rg) becomes less than 1 (one) and thus, discharge takes place along the discharge route that has been moved toward the downstream side by the gas flow u. Accordingly, as is indicated by a broken line, the length of the discharge channel is gradually extended. While, as a result of the outward extending of the discharge route, the resistance Rdc is gradually increased in accordance with increase in discharge time in cooperation with the influence of the expansion of the active species by the gas flow u. That is, each time the discharge is carried out, the is resistance ratio (Rdc/Rg) approaches 1 (one). In the example shown by the drawing, until the $37^{th}$ discharge, the resistance ratio (Rdc/Rg) is less than 1 (one) and until this $37^{th}$ discharge, an extension of the discharge channel is seen. With such extension, finally, the length of the discharge channel becomes 8 times as long as the shortest distance lg between the electrodes 21 and 22. This extension greatly contributes to growth of the flame core and shortening of the initial combustion period.

At the time of $38^{th}$ discharge, the resistance Rg of the air-fuel mixture placed along the shortest distance lg becomes lower than the resistance Rdc of the discharge route that makes a detour to the downstream side, and thus, a discharge takes place along the shortest distance lg. Accordingly, at this time, the extending movement of the discharge channel terminates. It is to be noted that, for ease of understanding, FIG. 10 is a simulation graph in which the resistance ratio (Rdc/Rg) is obtained assuming that the discharge channel would extend to the very end, and thus, the resistance ratio (Rdc/Rg) after the $38^{th}$ discharge is illustrated to further increase. However, actually, since the length of the discharge channel returns to the initial state (viz., shortest distance lg), it is considered that the resistance ratio (Rdc/Rg) reduces again and the discharge channel gradually increases again.

Figure 11:
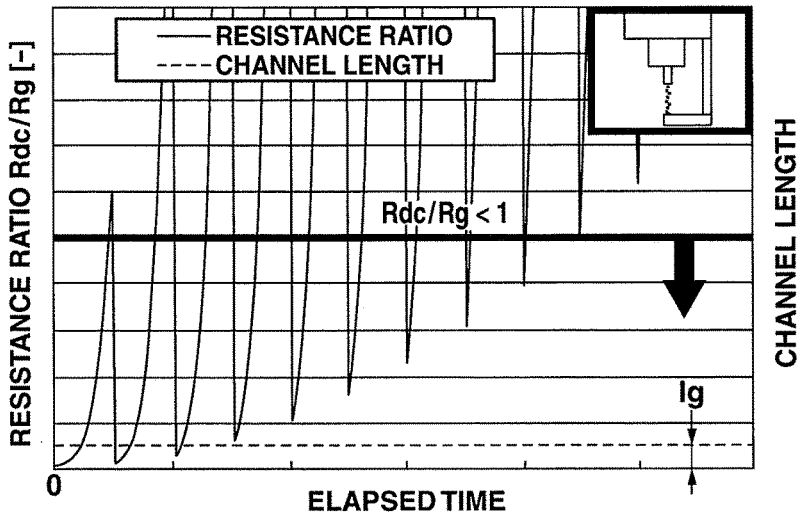
FIG. 11 is a time chart that depicts a resistance ratio (Rdc/Rg) used in a comparative example with a large discharge interval and a temporal change of the length of a discharge channel.

FIG. 11 shows a characteristic of a comparative example in which due to an increased discharge interval T, the resistance ratio (Rdc/Rg) does not take a value less than 1 (one). In this comparative example, after the $2^{nd}$ discharge, the resistance ratio (Rdc/Rg) shows a value larger than 1 (one) and thus the resistance Rg of the air-fuel mixture placed along the shortest distance (or shortest way) lg is lower than the resistance Rdc of the air-fuel mixture placed along the discharge route of the downstream side, and thus, after the $2^{nd}$ discharge, a discharge takes place along the shortest distance lg. Accordingly, extension of the discharge channel does not occur. The characteristic of the resistance ratio (Rdc/Rg) depicted by FIG. 11 is also a simulation data assuming that the discharge channel would extend to the very end, and thus, the characteristic is different from an actual one. Actually, it is considered that after $2^{nd}$ discharge, the resistance ratio (Rdc/Rg) keeps a constant value.

The time represented by the abscissa of FIG. 10 and the time represented by the ordinate of FIG. 11 are one the same scale, and the discharge interval T of the example of FIG. 10 is set to ⅕ of the discharge interval T of the example of FIG. 11.

Theoretically, the discharge channel becomes long as the discharge interval T becomes small and thus, energy applied to the air-fuel mixture is increased. However, actually, the ignitionability does not improve proportionally. Furthermore, since the voltage supplied from the high voltage generating circuit 16 is gradually restricted as the discharge is repeated, there is a suitable lower limit of the discharge interval T.

Figure 12:
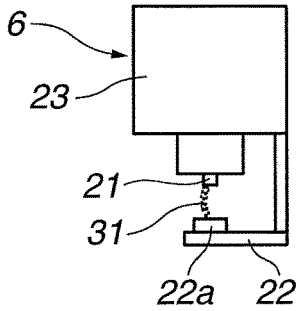
FIG. 12 is an illustration showing a condition in which a discharge channel is extended outward beyond the electrodes that have a narrower width.
Figure 13:
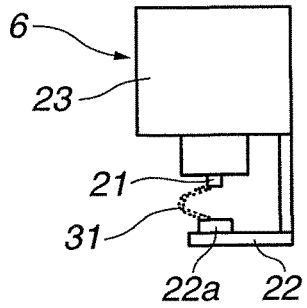
FIG. 13 is an illustration showing a condition in which a discharge channel is extended outward beyond the electrodes that have a wider width.

FIGS. 12 and 13 are drawings for explaining the formation of a discharge channel of the ignition plug 6 in a condition wherein the width of one of the electrodes is larger than that of the other of the electrodes. In the illustrated example, the width of a chip **22*a* placed on a leading end of the side electrode 22 is relatively larger than the width of a leading end of the center electrode 21. In case of using such ignition plug 6, it is desirable that by suitably setting the discharge interval T in the above-mentioned manner, a discharge channel 31 that is caused or produced by n-th time discharge and swelled out toward the downstream side of the gas flow u is shaped to extend outward from at least the narrower electrode 21 as is seen from FIG. 12. Furthermore, it is desirable that a discharge channel that is caused or produced by n-th time discharge is shaped to extend outward from the wider electrode 22. When, as is mentioned hereinabove, the discharge channel 31 is shaped to extend outward from the electrode 21 or 22, an extinction action possessed by the relatively low temperature electrodes 21 and 22**, that is, a cooling action applied to the flame core, is reduced, is which is advantageous in the growth of flame core.

The concept of the present invention for extending a discharge channel by using a gas flow is widely applicable regardless of shape and construction of the ignition plugs and electrodes.

In the following, an embodiment will be described with reference to FIG. 14 in which the discharge interval is not constant, that is, the discharge interval T is relatively increased in a period appearing just after starting of a discharge and the discharge interval T is relatively reduced in a period appearing after several discharges are carried out.

As is mentioned hereinabove, even in the presence of gas flow u, a discharge channel caused by a first discharge is produced along the shortest distance (or shortest way) lg between the two electrodes 21 and 22. Under the condition wherein the discharge channel is short, the resistance Rdc of the discharge route is low, and thus, even when the discharge internal T is relatively long, the discharge channel is gradually extended toward the downstream side by the gas flow u. However, when the discharge channel becomes long, the resistance Rdc of the discharge route extending along the extended discharge channel is increased and approaches the resistance Rg of the discharge route extending along the shortest distance lg.

Figure 15:
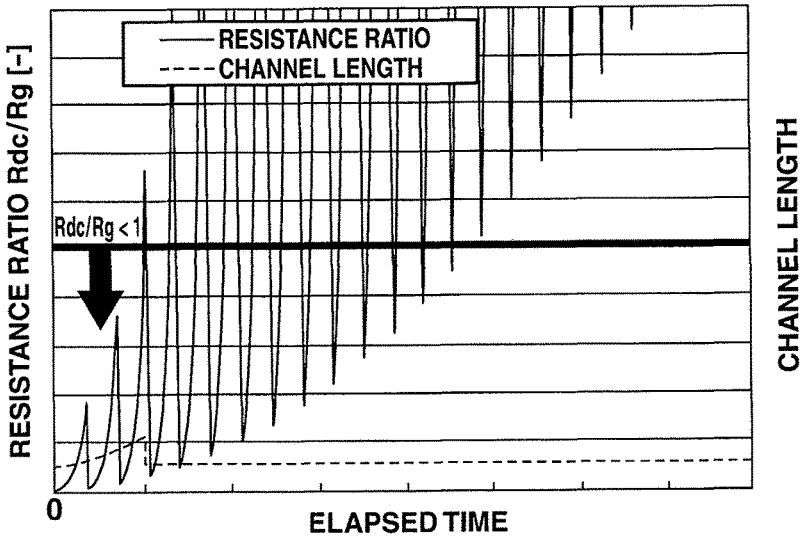
FIG. 15 is a time chart of a comparative example in which the discharge interval is set large.

In a comparative example depicted by FIG. 15, the discharge interval T is set relatively long and the discharge interval T is set constant, so that until the second discharge, the discharge channel is extended, but at the third discharge, the resistance ratio (Rdc/Rg) reaches 1 (one) causing a discharge along the shortest distance lg. Thus, the extending of the discharge channel is limited.

Figure 16:
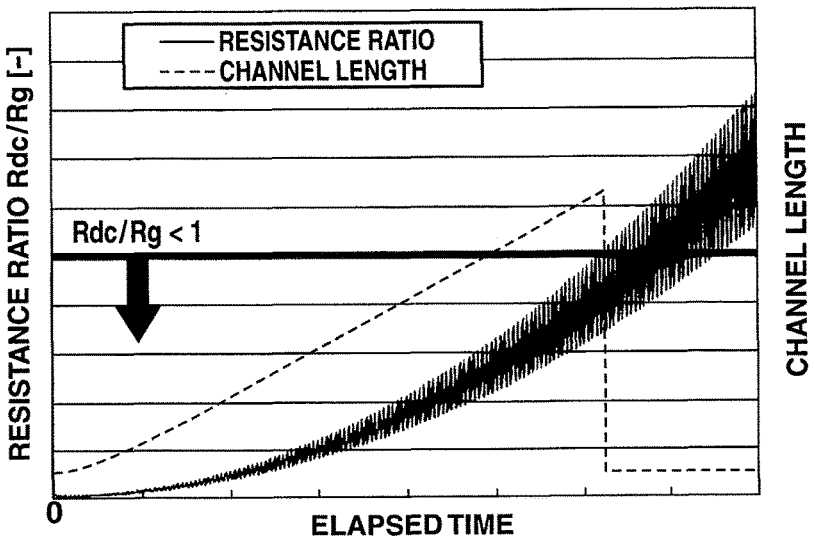
FIG. 16 is a time chart of another comparative example in which the discharge interval is set small.

While in a comparative example depicted by FIG. 16, the discharge interval T is set small, that is, set to 1/7 of that of FIG. 15. In this example, until the time when the resistance ratio (Rdc/Rg) comes to 1 (one), much larger extension of the discharge channel is obtained, but the number of discharge is large.

Figure 14:
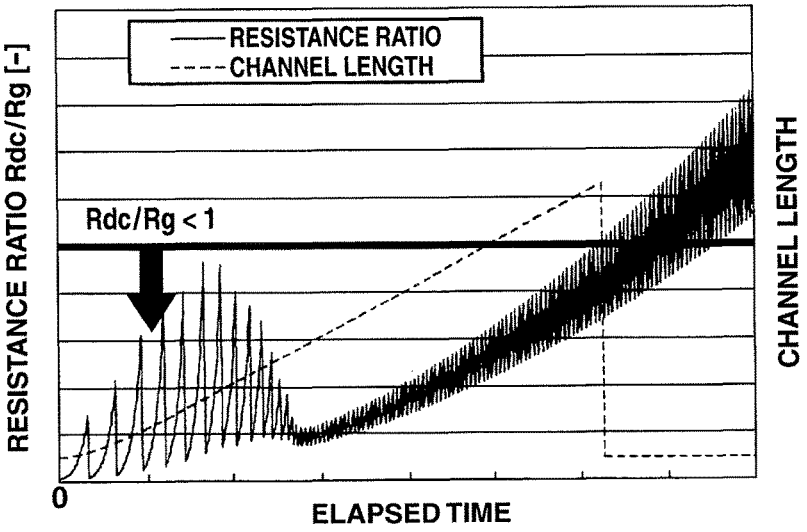
FIG. 14 is a time chart similar to FIG. 10, depicting a discharge interval that is varied in accordance with the number of times of discharge.

In the embodiment of FIG. 14, by taking the above-mentioned weak point into consideration, the discharge interval T is varied in accordance with the number n of discharges. More specifically, an initial discharge interval T from a first discharge to a second discharge is the same as that of the comparative example of FIG. 15, and the discharge interval T is gradually reduced or shortened with a passage of the third and fourth discharges, and the discharge interval T from the $15^{th}$ discharge to the $16^{th}$ discharge and thereafter is controlled to 1/7 of the initial discharge interval T (That is, the same as discharge interval T of the comparative example of FIG. 16).

By changing the discharge interval T in the above-mentioned manner, extension operation of the discharge channel is sufficiently obtained like in the comparative example of FIG. 16. And, the number of discharges required until the time when the discharge channel is maximally extended is reduced as compared the case of the comparative example of FIG. 16, and thus, the wear of the electrodes 21 and 22 is suppressed. For example, in the illustrated example, the number of discharges required until the time when the discharge interval T becomes 1/7 of that of the initial discharge becomes small, that is, 1/4 of that of comparative example of FIG. 16.

The method of shortening the discharge interval T in accordance with increase of the number n of discharges or elapsed time from the initial discharge has many ways.

Figure 17:
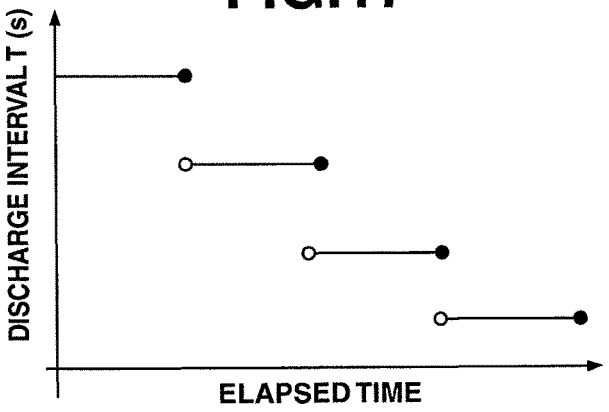
FIG. 17 is a characteristic diagram showing one example of changes of the discharge interval.
Figure 18:
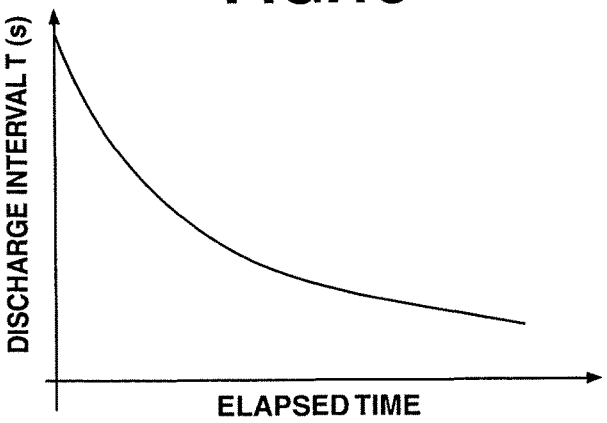
FIG. 18 is a characteristic diagram showing another example of the changes of the discharge interval.
Figure 19:
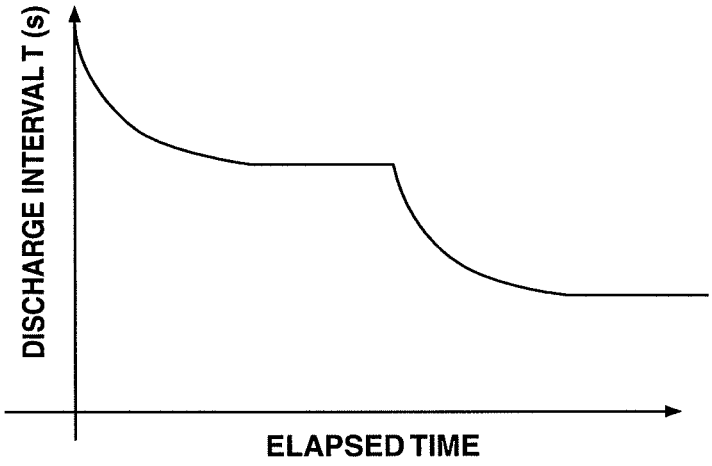
FIG. 19 is a characteristic diagram showing still another example of the change of the discharge interval.

FIGS. 17 to 19 show examples of the method. In the example of FIG. 17, the discharge interval T is stepwisely reduced in accordance with an elapsed time or increase of the number n of discharges. In the example of FIG. 18, the discharge internal T is continuously reduced. In the example of FIG. 19, a cycle is repeated in which the discharge interval T is continuously reduced, thereafter kept constant, thereafter continuously reduced again and thereafter kept constant.

The invention claimed is:

1. An ignition device of an internal combustion engine which carries out ignition of an air-fuel mixture by repeatedly applying a voltage across electrodes of an ignition plug thereby producing a plurality of discharges, the ignition device comprising an ignition improvement means which, in the presence of a gas flow of given strength of which direction is perpendicular to a direction that connects the electrodes with a shortest distance, is able to produce a discharge channel longer than the shortest distance thereby to assure the ignition in the presence of the gas flow, the ignition improvement means being so constructed that a time interval of discharges is set with respect to the strength of the gas flow and the life of active species produced by the discharges, so that the discharge channel caused or produced by the discharges is gradually extended in the gas flow direction and extension of the discharge channel is stably carried out by a plurality of times.

2. An ignition device of an internal combustion engine which carries out ignition of an air-fuel mixture by repeatedly applying a voltage across electrodes of an ignition plug thereby producing a plurality of discharges, the ignition device comprising an ignition improvement means which, in the presence of a gas flow of given strength of which direction is perpendicular to a direction that connects the electrodes with a shortest distance, is able to produce a discharge channel longer than the shortest distance thereby to assure the ignition in the presence of the gas flow, the ignition improvement means being so constructed that a time interval of discharges is set with respect to the strength of the gas flow and the life of active species produced by the discharges, so that extension of the discharge channel is stably carried out by a plurality of times by making a subsequent discharge within a time for which a resistance of a discharge route produced when active species produced by a previous discharge are forced to flow downstream by the gas flow is kept lower than a resistance of a route that connects the shortest distance.

3. An ignition device of an internal combustion engine as claimed in claim 1, in which the electrodes of the ignition plug comprise one electrode that is relatively small in width and the other electrode that is relatively large in width, and in which the discharge channel caused by n-th time discharge, $n \neq 1$, is shaped to extend outward from at least the electrode that is small in width.

4. An ignition device of an internal combustion engine as claimed in claim 3, in which the discharge channel caused by the n-th time discharge, n≠1, is shaped to extend outward from the other electrode that is large in width.

5. An ignition method of an internal combustion engine for carrying out ignition of an air-fuel mixture by repeatedly applying a voltage across electrodes of an ignition plug thereby producing a plurality of discharges, the ignition method comprising preparing an ignition improvement means which, in the presence of a gas flow of given strength of which direction is perpendicular to a direction that connects the electrodes with a shortest distance, is able to produce a discharge channel longer than the shortest distance thereby to assure the ignition in the presence of the gas flow, in which a time interval of the discharges is set with respect to the strength of the gas flow and the life of active species produced by the discharges, so that the discharge channel caused by each discharge is gradually extended in the gas flow direction and extension of the discharge channel is stably carried out by a plurality of times.

6. An ignition method of an internal combustion engine for carrying out ignition of an air-fuel mixture by repeatedly applying a voltage across electrodes of an ignition plug thereby producing a plurality of discharges, the ignition method comprising preparing an ignition improvement means which, in the presence of a gas flow of given strength of which direction is perpendicular to a direction that connects the electrodes with a shortest distance, is able to produce a discharge channel longer than the shortest distance thereby to assure the ignition in the presence of the gas flow, in which a time interval of discharges is set with respect to the strength of the gas flow and the life of active species produced by the discharges, so that extension of the discharge channel is stably carried out by a plurality of times by making a subsequent discharge within a time for which a resistance of a discharge route produced when active species produced by a previous discharge are forced to flow downstream by the gas flow is kept lower than a resistance of a route that connects the shortest distance.

7. An ignition device of an internal combustion engine as claimed in claim 1, in which a time interval between (n−1)-th time discharge and n-th time discharge is relatively small in a range where the value of the number n of discharges is relatively large as compared with a range where the value of the number n of discharges is relatively small.

8. An ignition method of an internal combustion engine as claimed in claim 5, in which a time interval between (n−1)-th time discharge and n-th time discharge is small in a range where the value of the number n of discharges is relatively large as compared with a range where the value of the number n of discharges is relatively small.

* * * * *